US011713101B2

(12) United States Patent
Hathaway et al.

(10) Patent No.: US 11,713,101 B2
(45) Date of Patent: Aug. 1, 2023

(54) PROPELLER HUBCAP

(71) Applicants: Jeffrey L. Hathaway, Manteo, NC (US); Kevin Goode, Nags Head, NC (US)

(72) Inventors: Jeffrey L. Hathaway, Manteo, NC (US); Kevin Goode, Nags Head, NC (US)

( * ) Notice: Subject to any disclaimer, the term of this patent is extended or adjusted under 35 U.S.C. 154(b) by 0 days.

(21) Appl. No.: 17/543,101

(22) Filed: Dec. 6, 2021

(65) Prior Publication Data

US 2022/0177095 A1 Jun. 9, 2022

Related U.S. Application Data

(60) Provisional application No. 63/121,614, filed on Dec. 4, 2020.

(51) Int. Cl.
*B63H 1/20* (2006.01)

(52) U.S. Cl.
CPC ..... *B63H 1/20* (2013.01)

(58) Field of Classification Search
CPC ... B63H 1/00; B63H 1/02; B63H 1/12; B63H 1/14; B63H 1/20
USPC ..... 440/49, 79; 416/93 R, 93 A, 189
See application file for complete search history.

(56) References Cited

U.S. PATENT DOCUMENTS 968,823 A 8/1910 Westinghouse
1,607,116 A 11/1926 Checkley
1,717,663 A 6/1929 Checkley
1,813,552 A 7/1931 Stechauner
3,246,698 A * 4/1966 Kiekhaefer ..... B63H 20/245 416/189
3,549,271 A 12/1970 Hidetsugu
3,589,833 A * 6/1971 Lancioni ..... B63H 1/18 416/93 R
4,212,586 A * 7/1980 Aguiar ..... B63H 20/245 416/93 A
4,604,032 A 8/1986 Brandt et al.
5,096,383 A 3/1992 Dobrzynski
6,682,377 B2 1/2004 Ishikawa et al.
7,407,366 B2 8/2008 Hedlund et al.
8,702,395 B2 4/2014 Gearhart
(Continued)

FOREIGN PATENT DOCUMENTS

CA 1289821 C 10/1991
EP 0406451 B1 7/1993
(Continued)

*Primary Examiner* — Daniel V Venne
(74) *Attorney, Agent, or Firm* — Millen, White, Zelano & Branigan, PC; Ryan Pool

(57) ABSTRACT

The invention is directed to a propeller hubcap and method for installing a propeller hubcap which includes attaching a propeller hubcap to main propeller where the main propeller has at least two blades and a shaft and where the shaft has a diameter of from 2.5 inches to 6 inches. The propeller hubcap includes a central body and propeller blades, where the propeller blades are timed with the blades of the main propeller. A thick and thin nut are provided on the main propeller shaft where the thick or thin nut which is positioned further from the main propeller is tapped by multiple holes which have received a fastener. The fasteners attach the propeller hubcap to the main propeller shaft via complementary holes in the central body of the propeller hubcap.

11 Claims, 7 Drawing Sheets

(56) References Cited

U.S. PATENT DOCUMENTS

| | | | | |
|---|---|---|---|---|
| 9,701,379 | B2 * | 7/2017 | Hawkins | B63H 1/28 |
| 9,914,515 | B1 * | 3/2018 | Powers | B63H 1/28 |
| 2003/0003821 | A1 | 1/2003 | Ishikawa et al. | |
| 2007/0098559 | A1 | 5/2007 | Hedlund et al. | |

FOREIGN PATENT DOCUMENTS

| | | | |
|---|---|---|---|
| EP | 0758606 | A1 | 2/1997 |
| GB | 2194295 | A1 | 3/1988 |
| GB | 2474817 | B | 1/2013 |
| GB | 2474818 | B | 1/2013 |
| JP | 62103295 | A | 5/1987 |
| JP | 1311982 | A | 12/1989 |
| JP | 2063994 | A | 3/1990 |
| JP | 4212695 | A | 8/1992 |
| JP | 5039090 | A | 2/1993 |
| JP | 6099892 | A | 4/1994 |
| JP | 7089487 | A | 4/1995 |
| JP | 8282590 | A | 10/1996 |
| JP | 2006306145 | A | 11/2006 |
| JP | 2009051283 | A | 3/2009 |
| JP | 5496563 | B2 | 5/2014 |
| SG | 10201810020 | A1 | 12/2018 |

* cited by examiner

PROPELLER HUBCAP

BACKGROUND

Propellers are a well know manner of propelling watercraft through the water. However, known problems created by propellers is cavitation and hub vortex. Cavitation is generally described as the formation of small vapor-filled cavities in places where the pressure is relatively low which is caused by rapid changes of pressure in a liquid. hub vortex is generally described as the difference in flow velocity between the upper and lower surface of the propeller blade. This results in a strong downward flow from the trailing edge of the blade. The downward flow of each blade integrates into a strong hub vortex. As a result of the hub vortex, the propulsion energy of the propeller decreases.

Some of the negative impacts of cavitation include wear and tear on mechanical parts and vibrations in vessel. The reduction or elimination of cavitation is therefore a desirable trait and a long felt need in the field of propeller propulsion particularly in the marine vessels which use propellers.

Additionally, when conventional boss caps are added to a propeller a strong vortex is generated which is known as hub vortex. Hub vortex also results in loss of efficiency of the propeller. While it is known to fit bladed boss caps on propellers for large commercial vessels like containerships, ferries, car carriers, bulk carriers, LNG carriers, and tankers, there is no structure or method for smaller water craft.

In the larger commercial vessels, a cone shaped end cap is used to deflect water flow to reduce forming of the vortex. This cap can only be attached to the outer nut with bolts or with set screws outside of hub.

SUMMARY OF THE INVENTION

The current invention is directed to a propeller hubcap also referred to as a boss cap for small marine vehicles which include watercraft with a propeller shaft of about 6 inches or less. The current invention is directed to a method of attaching the propeller hubcap also referred to as a boss cap to a small marine vehicle. The propeller hubcap functions to reduce cavitation and unexpectedly improves both speed and fuel economy per fuel used, i.e., it unexpectedly makes an otherwise identical engine output more power while simultaneously increasing efficiency. The propeller hubcap functions to reduce the hub vortex and cavitation behind the propeller that is generated by the water stream leaving the propeller. This results in fuel savings, increased vessel speed, reduced engine load, reduced underwater noise and vibration, and reduces cavitation.

In some embodiments, propeller boss cap is mounted over the propeller nuts (a thick and a thin). The rear most nut (thick or thin) is drilled and tapped in multiple locations, for example, 2, 3, 4, 5, 6, 7, 8, 9, 10, 11, or 12 locations. In the preferred embodiment six locations are used. This facilitates the attachment of the cap with the holes in the rear most end of the cap.

In some embodiments, the propeller hubcap is added, fitted, or retrofitted to an already existing engine/propeller.

In some embodiments, the propeller hubcap is made of solid material, for example, stainless steel, bronze, silicon bronze, carbon fiber, or 3-D printed plastic that is comprised of a round tube of the same diameter as the propeller hub. In some embodiments, the propeller hubcap has an end cap with holes which allow for attachment of the propeller hubcap to the propeller nut, for example, with bolts. In some embodiments, the propeller hubcap can also be center drilled to the propeller shaft with, for example, one threaded bolt. In some embodiments, each propeller hubcap is custom built to the size propeller that is being fitted, including the diameter, pitch, and rotation.

This cap can be produced in various sizes depending on the size of the engine and propeller to which the propeller hubcap is intended to be fitted. For example, most boats will likely require a propeller hubcap which has a 2.5-inch propeller shaft up to a 6-inch propeller shaft. In some embodiments, the most produce positive results are obtained from vessels at their cruise speed. Cruise speed generically means the speed at which an airplane, a boat, etc., usually moves when it is traveling at a fast speed for a long distance. Cruising speed is generally less than but may include maximum speed in come vessels. Examples of vessels to which the invention may be applied include, for example, sport fishing boats, yachts, crew boats, high-speed tour boats, oil platform supply boats, etc.

In some embodiments, the propeller hubcap is designed to match blade propellers having from 4 blade to 7 blade propellers. In some embodiments, the number of propeller cap blades can match or exceed the number of blades of the propeller. Example, a 5-blade propeller may have a cap with 10 blades but not less than 5 blades on the vessel application. Each blade must be behind the main propeller blade. This is referred to as timed. Such positioning redirects the water leaving the main propeller to prevent the formation of a hub vortex. The number of blades can be modified to eliminate timing to the main propeller as double blades will catch all of the water leaving the main propeller. In some embodiments, the size of the blades must be smaller than the main propeller or they will generate drag, for example, by protruding into the stream of water pushing the vessel. The hub vortex is attached to the hub of the propeller cap and the smaller more abundant blades can catch the vortex like an auger.

In some embodiments, the propeller hubcap is attached by a method suitable for small marine vessels, for example, in some embodiments, the propeller hubcap is attached by bolting the propeller hubcap to the rear propeller nut with bolts and drilled and tapped treads. Small marine vessels are those having a shaft diameter of from 1 to 8 inches, preferably 2.5 to 6 inches. Such small marine vessels secure their propellers with a large nut against the hub of the propeller and at the thin jam nut against the thick nut followed by a cotter key through the drilled hole on the very end of the shaft. In some embodiments, the method of attachment is not affected by the use of a cotter key. Generally, cotter keys are designed to stop the rear nut from backing off.

Due to the size of the propeller nuts in small marine vessels applications, there is only enough room for the barrel of cap of the current invention to rest against the hub of the propeller. In some embodiments, the cap is secured to the propeller by bolting it to the rear nut. In some embodiments, the hub of the cap must be the same diameter as the hub of the propeller or smaller. In some embodiments, it cannot protrude outside of the propeller hub as it will cause a negative disturbance. In some embodiments, the diameter of the cap is from 33% to 99% the diameter of the main propeller.

This method of attachment of the current invention differs from that which is used on larger vessels, for example, tankers because the hubs on larger vessels is much larger than the shafts of small marine vessels or personal watercraft which generally range between 2.5 inches to 6 inches.

Large ships achieve attachment using a nut called a pilgrim nut. A pilgrim nut is a hollow steel, internally treaded device that screws on to the propeller shaft behind the main propeller. Hydraulic pressures are applied to the hollow portion of the nut and an internal piston expands like a break caliper to push the propeller up onto the shaft taper.

All large ship propellers are drilled and tapped around the outer edge of the hub to facilitate the attachment of a boss cap. Of the blade type boss caps, all ship propellers use a round streamlined boss cap installed over the pilgrim nut. Large ships use only one nut on their propellers, e.g. the pilgrim nut. A pair of traditional nuts typically used on smaller vessels will not generally provide enough tightening torque to secure such a large propeller.

In some embodiments of the current application, two nuts are used on the propeller. In some embodiments, the two nuts are a thick and a thin nut. The thick nut being thicker than the thin nut. In some embodiments, only the one of the thick and thin nuts is taped, e.g. holes drilled in the nut and bolts inserted. In some embodiments, only the rear nut is tapped, e.g., the nut closest to the boss cap and furthest from the propeller.

In some embodiments, the thick and thin nuts are not hollow. In some embodiments, the rear nut is the thick nut. In some embodiments, the rear nut is the thin nut. The device is also threaded onto the rear of the propeller shaft, but this nut is smaller in diameter and it leaves more room around it to bolt a propeller boss cap directly to the propeller hub.

In some embodiments, the thin nut is installed first on the assembly. In other embodiments the thick nut is installed first on the assembly.

The pilgrim nut is unique in its design as it is hollow and hydraulic pressure is applied to push the propeller onto the shaft taper. It also is used with special adaptors to use hydraulic pressure to unseat the propeller from the shaft taper. Therefore, this nut must be protected from the outside elements, seawater, debris, rope and corrosion. All ships use a boss cap of one design or another. However, no large ships drill and tap this pilgrim nut as the method herein method requires at least because of the dangers above.

In some embodiments, the vortex reducing boss cap on ship propellers is custom made for each propeller. A timing mark is placed on the cap and the propeller and is designed to line up with the bolt holes in the hub. For example, in some embodiments, 6 bolt holes are provided on the rear nut to allow for six rotations of the hub cap. This allows the cap six positions where they can be placed behind the blades of the main propeller. In some embodiments, the bolt holes in the cap are not drilled in line with the blades as this provides flexibility in the selection of the ultimate blade location by choosing different holes during installation. That is, the drilled rear nut may end up in a different location each time the nuts are removed and reinstalled. Timing marks can optionally be installed for future reference if the hub caps are removed and/or replaced.

In some embodiments, the vortex reducing propeller hubcaps are also custom made for each propeller and must be timed when installed. In some embodiments, the caps match the pitch angle of the main propeller. In some embodiments the left and right caps match the rotation of the main left and right propellers. Using six bolt-holes allows for rotation of the cap to time the cap at each installation due to the fact that the nuts end up in a different spot on each.

In some embodiments, the propeller hub-caps are custom made to each shaft-nut combination with respect to barrel size.

In some embodiments, all 2.5 to 6-inch shafts will be standard in that each shaft size will share the same bolt pattern for that size and will keep the barrel the same diameter and length. The custom-made aspect will require a number of blades, blade size, pitch angle and left or right rotation.

In some embodiments, the propeller hubcap blades are centered between the blades of the vessel propeller.

In addition to the difference in shaft size there are a number of other differences between watercraft intended for personal use, the largest of which is a yacht, for which the current invention is designed to be applied and commercial shipping vessels like tankers or barges. For example, the revolutions per minute (RPM) of propellers used in these vessel types are different. Large commercial vessels generally operate at RPM of about 400 whereas the invention of the current application is designed for use with propellers moving at 1,000 RPM. Additionally, the cruising speeds are similarly in a different class. Large commercial vessels generally operate at cruising speeds of 20-25 knots while watercraft intended for personal use can operate at cruising speeds of 30-38 knots.

The modern watercraft industry making watercraft intended for personal use to which the invention can be applied are already very efficiently designed and highly sophisticated. Computer controlled diesel engines monitor, for example, load, RPM, speed, and fuel burn per hour. Therefore, further increasing the efficiencies of these water craft is very difficult.

EXAMPLE

The data below was obtained at cruising speed of a 65-foot Paul Mann Sport fish Vessel with 1650 horse power Caterpillar Engines. The RPM range was from 1700 RPM to 2100 RPM but averaged 1800 RPM:

| Without Prop Caps: | With Prop Caps: |
|---|---|
| 1800 RPM | 1800 RPM |
| 55 Gallons Per Hour | 53 Gallons Per Hour |
| 34 Knots | 35 Knots |

The prop caps therefore resulted in around 4% fuel savings while also increasing the speed of the vessel at the same RPM. Such a vessel will generally cruise around 325 hours per year at 1800 RPMs saving a total of 4 gallons per hour. At an average cost of $3.00 per gallon, the prop cap saves $3,900.00 per year while simultaneously increasing the performance of the vessel. It is surprising and unexpected that a single modification could produce both an increase in performance (measured by speed produced per RPM) while simultaneously producing an increase in fuel efficiency (measured by gallons per hour at 1800 RPM).

Some embodiments include a method for installing a propeller hubcap including:

attaching a propeller hubcap to main propeller, wherein the main propeller has at least two blades and a shaft wherein the shaft has a diameter of from 2.5 inches to 6 inches, wherein the propeller hubcap comprises a central body and propeller blades, wherein the propeller blades are timed with the blades of the main propeller, wherein a thick and thin nut are provided on the main propeller shaft wherein the thick or thin nut which is positioned further from the main propeller is tapped by multiple holes which have received a fastener wherein said fasteners attach the propeller hubcap to the main propeller shaft via complementary holes in the central body of the propeller hubcap.

Some embodiments include the method for installing a propeller hubcap above wherein the number of blades on the propeller hubcap meets or exceeds the number of blades on the main propeller.

Some embodiments include the method for installing a propeller hubcap above wherein central body of the propeller hubcap extends to the main propeller and covers the thick and thin nuts.

Some embodiments include the method for installing a propeller hubcap above wherein holes in the propeller hubcap are positioned out of line with the blades of the propeller hubcap.

Some embodiments include the method for installing a propeller hubcap above wherein the holes propeller hubcap and thick or thin nut positioned furthest from the main propeller have 6 holes.

Some embodiments include a propeller including:

a main propeller comprising least two blades and a shaft wherein the shaft has a diameter of from 2.5 inches to 6 inches, a propeller hubcap positioned downstream from the main propeller and comprising a central body and propeller blades, wherein the propeller blades are timed with the blades of the main propeller, wherein a thick and thin nut are provided on the main propeller shaft wherein the thick or thin nut which is positioned further from the main propeller and closer to the propeller hubcap is tapped by multiple holes which have received a fastener wherein said fasteners attach the propeller hubcap to the main propeller shaft via complementary holes in a central body of the propeller hubcap.

In some embodiments, the number of blades on the propeller hubcap meets or exceeds the number of blades on the main propeller.

In some embodiments, the central body of the propeller hubcap extends to the main propeller and covers the thick and thin nuts.

In some embodiments, the holes in the propeller hubcap are positioned out of line with the blades of the propeller hubcap.

In some embodiments, the thick or thin nut positioned furthest from the main propeller and the central body of the propeller hubcap have 6 holes.

In some embodiments, the propeller is operated at an RPM of at least 1700.

BRIEF DESCRIPTION OF THE DRAWINGS

FIG. 7 shows the propeller hubcap attached to the main propeller with bolts partially screwed in.

FIG. 1 illustrates a propeller hubcap or propeller boss cap (1) being fitted to the main propeller (2) over a pilgrim nut (3). In some embodiments, the propeller hubcap (1) will completely cover the pilgrim nut (3) and be positioned directly adjacent and/or abut the main propeller (2).

FIG. 2 illustrates the assembly under the propeller hubcap. This assembly includes at least two propeller nuts, a thick nut (5) and a thin nut (4). In the illustrated embodiment of FIG. 2 the thin nut (4) it positioned as the rear nut (8) and the thick nut (5) is positioned as the pilgrim nut (3). In some embodiments the rear nut is defined as the nut which is positioned closer to the propeller hubcap (1) and the pilgrim nut (3) is defined as the nut which is positioned closer to the main propeller (2).

FIG. 3 illustrates the propeller hubcap (1) attached to the main propeller (2) in its final position. The propeller hubcap (1) attached to the main propeller (2) via six bolts (6). In other embodiments, the number of bolts (6) can vary.

FIG. 4 illustrates a pilgrim nut (3) tapped with six bolts (6) and attached to the main propeller shaft (7) with a treaded screw fitting.

FIG. 5 illustrates a thick nut (5) posited as the pilgrim nut (3) and a thin nut (4) posited as the rear nut (8) and the main propeller (2).

FIG. 6 illustrates a nut assembly tapped with six bolts (6) and attached to the main propeller shaft (7) and main propeller (2).

FIG. 7 illustrates the propeller hubcap (1) attached to the main propeller (2) with bolts (6) partially screwed in. The blades of the propeller hubcap (1) are shown as centered between the blades of the main propeller (2).

Figure 1:
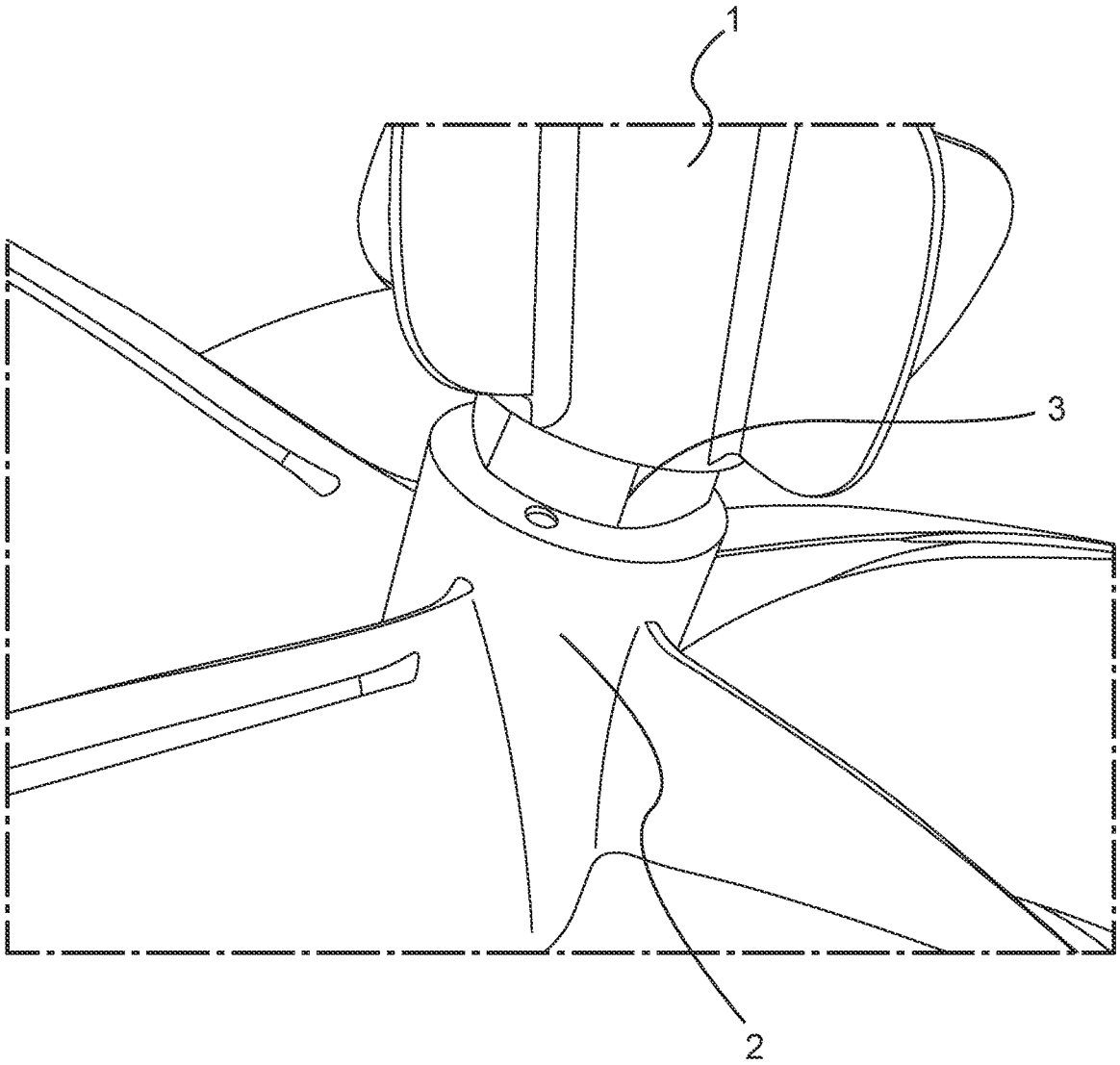
FIG. 1 shows the propeller hubcap being fitted to the main propeller over the pilgrim nut.
Figure 2:
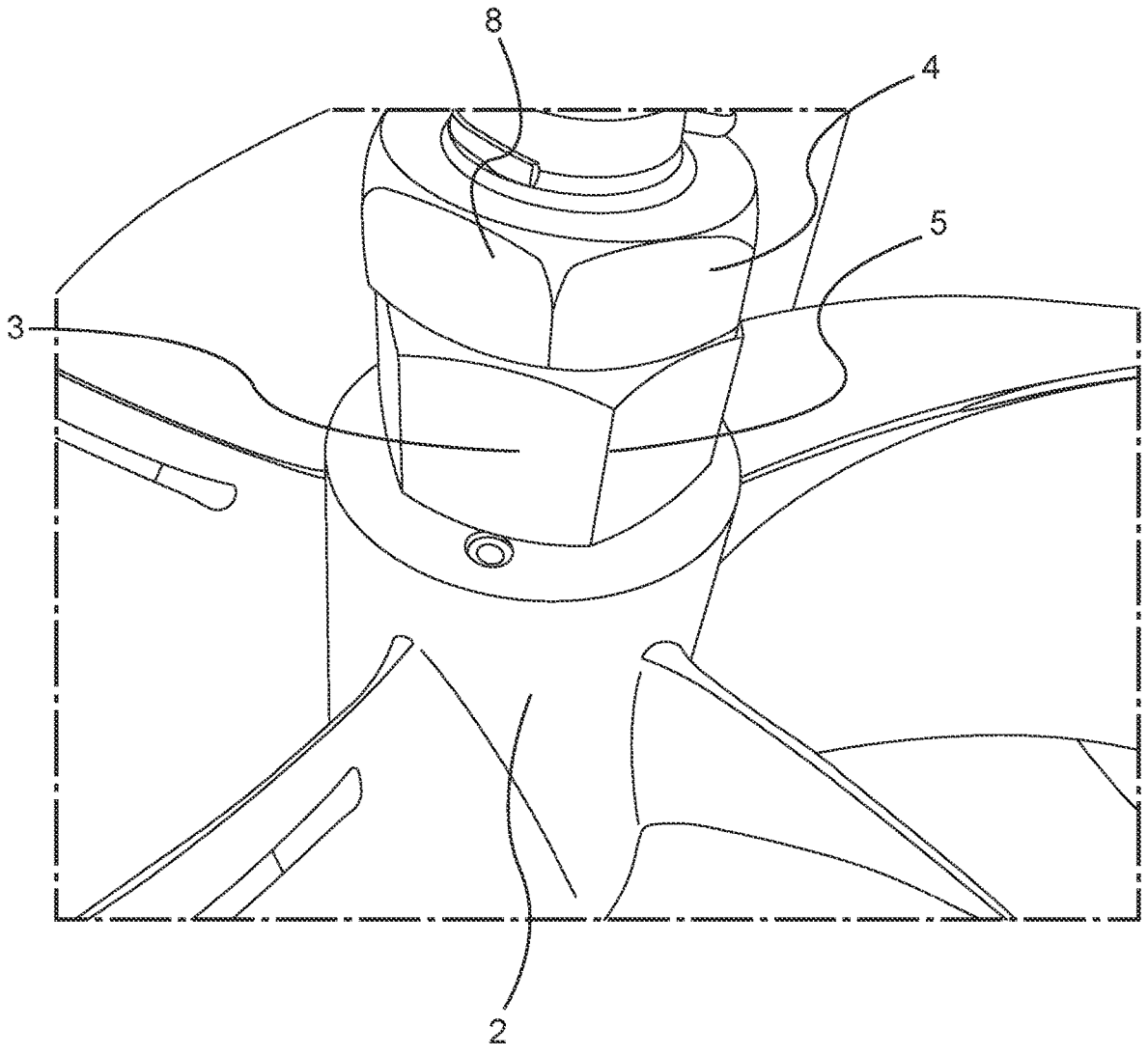
FIG. 2 shows the assembly under the propeller hubcap.
Figure 3:
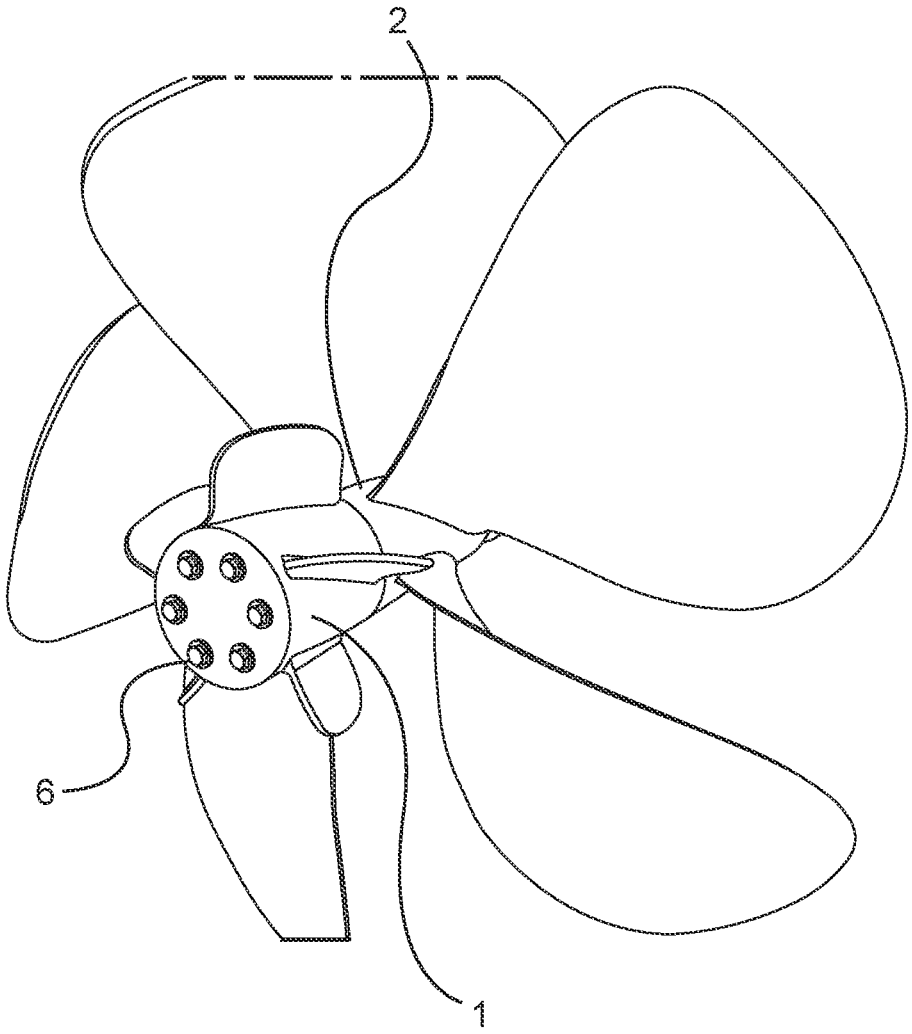
FIG. 3 shows the propeller hubcap attached to the main propeller in its final position.
Figure 4:
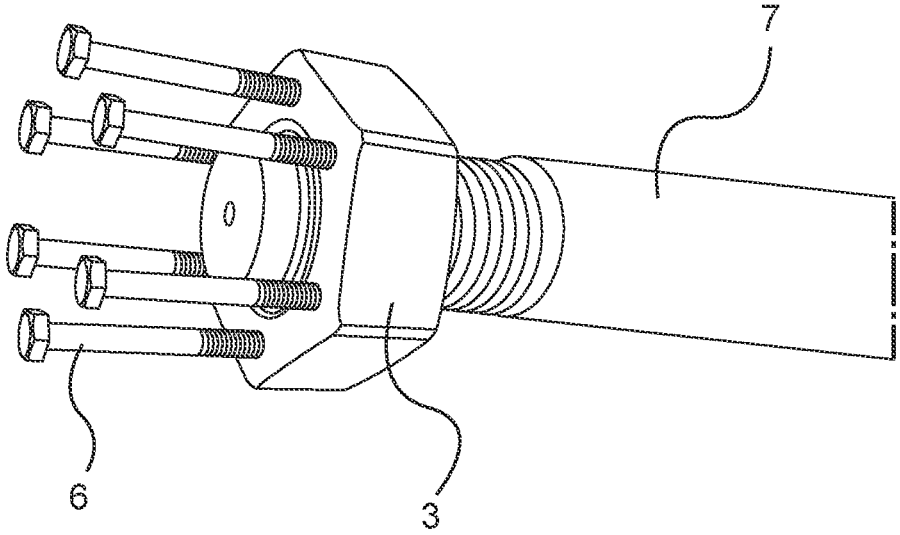
FIG. 4 shows a pilgrim nut tapped with six bolts and attached to a shaft with a treaded screw fitting.
Figure 5:
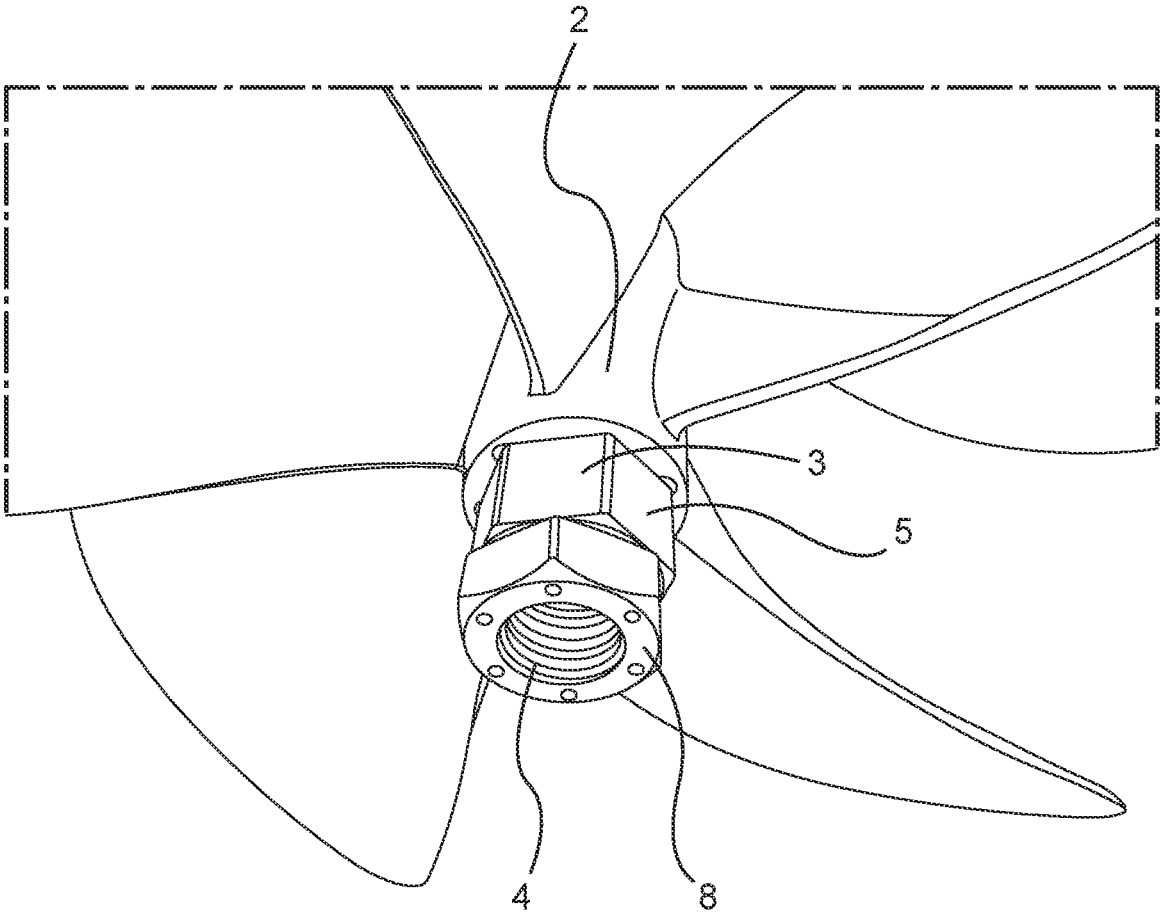
FIG. 5 shows a nut assembly and a main propeller.
Figure 6:
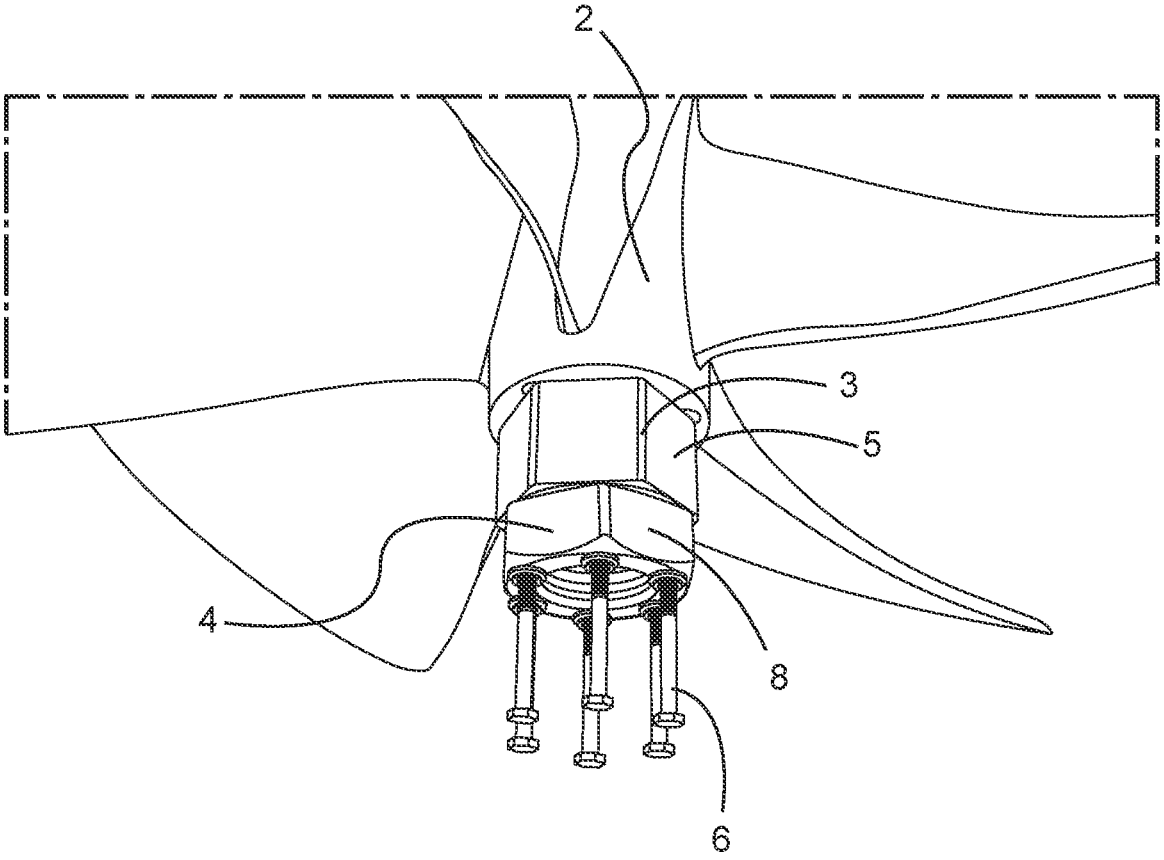
FIG. 6 shows a pilgrim nut assembly tapped with six bolts and attached to a shaft and main propeller.
Figure 7:
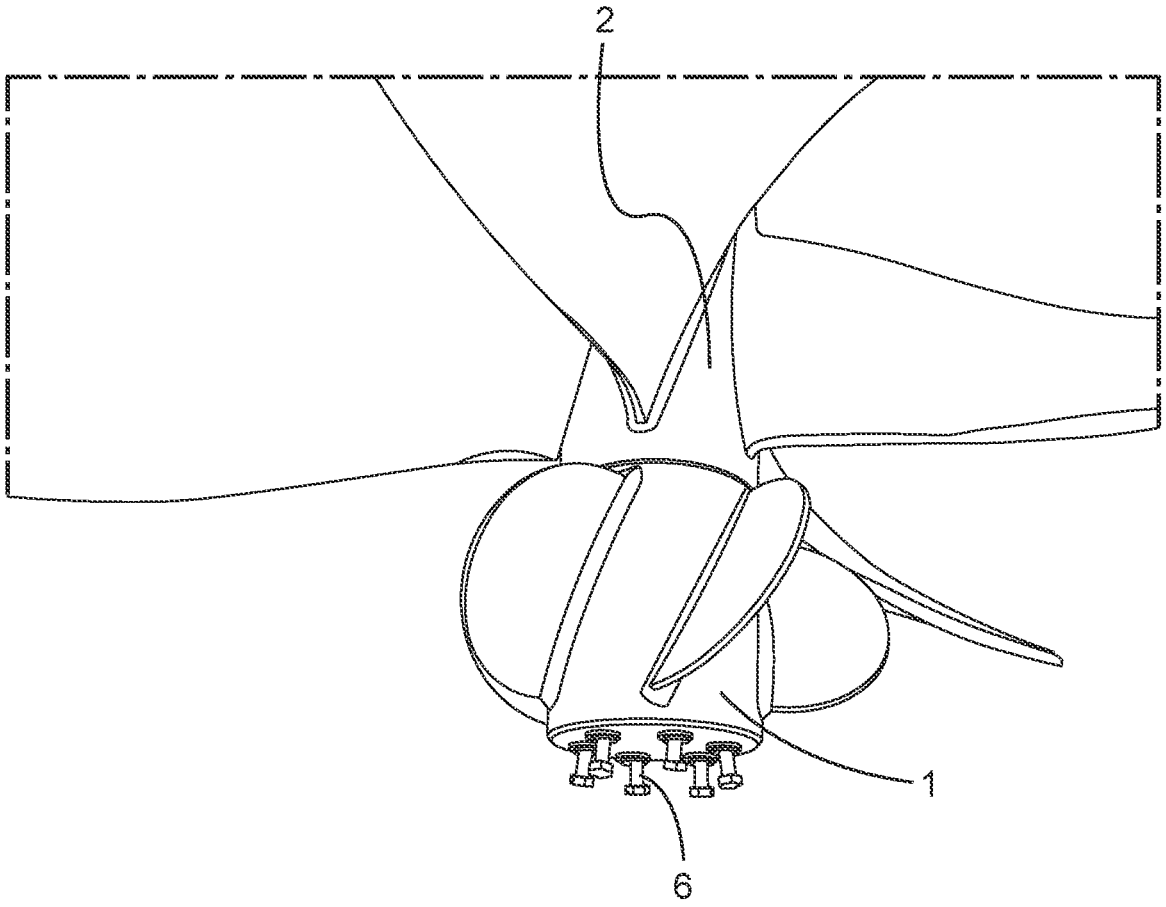

The invention claimed is:

1. A method for installing a propeller hubcap comprising:

attaching a propeller hubcap to main propeller, wherein the main propeller has at least two blades and a shaft wherein the shaft has a diameter of from 2.5 inches to 6 inches, wherein the propeller hubcap comprises a central body and propeller blades, wherein the propeller blades are timed with the blades of the main propeller, wherein a thicker and thinner nut, relative to each other are provided on the main propeller shaft wherein the thicker or thinner nut which is positioned further from the main propeller is tapped by multiple holes which have received a fastener wherein said fasteners attach the propeller hubcap to the main propeller shaft via complementary holes in the central body of the propeller hubcap.

2. The method of installing a propeller hubcap of claim 1 wherein the number of blades on the propeller hubcap meets or exceeds the number of blades on the main propeller.

3. The method of installing a propeller hubcap of claim 1 wherein central body of the propeller hubcap extends to the main propeller and covers the thicker and thinner nuts.

4. The method of installing a propeller hubcap of claim 1 wherein holes in the propeller hubcap are positioned out of line with the blades of the propeller hubcap.

5. The method of installing a propeller hubcap of claim 1 wherein the thicker or thinner nut positioned furthest from the main propeller and the central body of the propeller hubcap have 6 holes.

6. A propeller comprising:

a main propeller comprising least two blades and a shaft wherein the shaft has a diameter of from 2.5 inches to 6 inches, a propeller hubcap positioned downstream from the main propeller and comprising a central body and propeller blades, wherein the propeller blades are timed with the blades of the main propeller, wherein a thicker and thinner nut, relative to each other, are provided on the main propeller shaft wherein the thicker or thinner nut which is positioned further from the main propeller and closer to the propeller hubcap is tapped by multiple holes which have received a fastener wherein said fasteners attach the propeller hubcap to the main propeller shaft via complementary holes in a central body of the propeller hubcap.

7. The propeller of claim 6 wherein the number of blades on the propeller hubcap meets or exceeds the number of blades on the main propeller.

8. The propeller of claim 6 wherein central body of the propeller hubcap extends to the main propeller and covers the thicker and thinner nuts.

9. The propeller of claim 6 wherein holes in the propeller hubcap are positioned out of line with the blades of the propeller hubcap.

10. The propeller of claim 6 wherein the thicker or thinner nut positioned furthest from the main propeller and the central body of the propeller hubcap have 6 holes.

11. A method for operating a marine vehicle comprising:

operating a marine vehicle including the propeller of claim 6 wherein the propeller is operated at an RPM of at least 1700.

* * * * *